US006415733B1

(12) United States Patent
Hudson et al.

(10) Patent No.: US 6,415,733 B1
(45) Date of Patent: Jul. 9, 2002

(54) INTEGRATED FISH LANDING NET STORAGE COMPARTMENT

(75) Inventors: Jeffrey T. Hudson; Neil Ohrdorf, both of Murfreesboro, TN (US)

(73) Assignee: Genmar IP LLC, Minneapolis, MN (US)

( * ) Notice: Subject to any disclaimer, the term of this patent is extended or adjusted under 35 U.S.C. 154(b) by 0 days.

(21) Appl. No.: 09/633,531

(22) Filed: Aug. 7, 2000

(51) Int. Cl.[7] ..... B63B 3/56
(52) U.S. Cl. ..... 114/343; 114/78
(58) Field of Search ..... 114/78, 85, 178, 114/201 R, 343, 355, 363, 364; D12/317, 318; 220/4.01, 23.87, 254, 259, 523, 253, 255, 256, 826

(56) References Cited

U.S. PATENT DOCUMENTS 2,203,565 A * 6/1940 Field ..... 114/343
4,146,279 A * 3/1979 Stahel ..... 312/235.8
4,266,707 A * 5/1981 Rossman ..... 224/275
4,418,823 A * 12/1983 Romick ..... 206/538
4,621,587 A * 11/1986 Pool ..... 114/39.26
4,662,303 A * 5/1987 Duff ..... 114/343
4,768,651 A * 9/1988 Lanius ..... 206/315.11
4,995,577 A * 2/1991 Wood ..... 248/205.3
5,156,291 A * 10/1992 Mielke ..... 220/254
5,305,544 A * 4/1994 Testa , Jr. ..... 43/54.1
5,337,911 A * 8/1994 Holub ..... 220/254
5,390,621 A * 2/1995 Hattori et al. ..... 114/55.51
5,657,894 A * 8/1997 Bowen ..... 220/837
5,975,002 A * 11/1999 Rieger ..... 114/343
6,129,400 A * 10/2000 Jakubiec et al. ..... 296/37.14

* cited by examiner

*Primary Examiner*—S. Joseph Morano
*Assistant Examiner*—Andrew Wright
(74) *Attorney, Agent, or Firm*—Merchant & Gould P.C.

(57) ABSTRACT

A storage system for incorporation in a boat or other vessel. The storage system includes an integrated fish landing net storage compartment which is readily accessible to a fisherman standing on a casting deck of a boat. The dedicated storage compartment keeps a dirty and/or wet landing net away from other stowed items. The storage compartment is accessible via a dual-lid access hatch with latch built into the casting deck. The storage compartment preferably comprises a polyethylene storage box which is self-draining to the bilge, allowing the storage box to be cleaned easily. The storage compartment further has a snag-free design which whereby the storage box has no protruding hardware, Therefore, the landing net will not get caught during retrieval or stowage. In addition, universal and adjustable mounting brackets are used which allow for adaptation to many different boat models, as well as providing the ability to retrofit pre-existing boat models.

16 Claims, 6 Drawing Sheets

INTEGRATED FISH LANDING NET STORAGE COMPARTMENT

FIELD OF THE INVENTION

This invention generally relates to fishing boats. In particular, the invention relates to designs and devices for storing fishing equipment on a fishing boat.

BACKGROUND OF THE INVENTION

Specialized fishing craft known as "bass boats" have become extremely popular with both professional and amateur freshwater bass fisherman. The typical bass boat is generally provided with a centrally positioned control console disposed in a cockpit located between elevated bow and stern fishing or casting deck areas. These two elevated deck areas are each typically provided with pedestal-type fishing chairs to enhance the fisherman's comfort during a fishing expedition.

Bass boats are especially adapted for use in bass fishing competition. Current bass boats are designed with flat deck areas for fishing. One type of bass boat has a centrally located cockpit comprising seats, steering and throttle control. When in use, one person will fish, standing on the elevated bow fishing or casting deck area, forward of the cockpit, while another person stands on the elevated stern fishing or casting deck area to the rear of the cockpit.

It is known to provide storage compartments beneath the bow and stern casting decks of a bass boat for storing fishing tackle, fish, clothing, emergency equipment, etc. Each storage compartment has an opening which is covered by a hinged cover or hatch that forms part of either the bow or stern casting deck. When the hinged cover is lifted and pivoted upward, a fisherman can access the interior of a storage compartment to insert or remove an object into or from the compartment. When the hinged cover is lowered into the closed position, it lies flush with the surrounding casting deck area and can support the weight of a fisherman.

After a fisherman has hooked a fish and reeled it in, a fisherman typically captures the dangling fish in a fish landing net having the shape of a tennis racquet. When the time comes to stow the fish landing net, the net may be dirty and wet. Therefore it is undesirable to stow the soiled or wet fish landing net in a storage compartment containing other stowed items. There is a need for a storage compartment on a fishing boat which is dedicated for use in stowing a fish landing net. Preferably such a storage compartment should have a means of draining water which drips off of the landing net inside the compartment.

SUMMARY OF THE INVENTION

The present invention is directed to a storage system for incorporation in a boat or other vessel. The storage system comprises an integrated fish landing net storage compartment which is readily accessible to a fisherman on the casting deck. The dedicated storage compartment keeps a dirty and/or wet landing net completely away from other stowed items. The storage compartment is accessible via a dual-lid access hatch with latch built into the casting deck. The storage compartment preferably comprises a polyethylene storage box which is self-draining to the bilge, allowing the storage box to be cleaned easily. The storage compartment further has a snag-free design which whereby the storage box has no protruding hardware, Therefore, the landing net will not get caught during retrieval or stowage. In addition, universal and adjustable mounting brackets are used which allow for adaptation to many different boat models, as well as providing the ability to retrofit pre-existing boat models.

In accordance with the preferred embodiment, the storage system comprises a bilge compartment covered by a pivotable outer bilge access lid, which forms part of a casting deck. The storage system further comprises a storage compartment arranged within the bilge compartment and beneath the outer bilge access lid. The outer bilge access lid has an opening which overlies the storage compartment when the outer bilge access lid is flush with the rest of the casting deck. An inner storage lid is seated in the opening and is pivotably mounted to the outer bilge access lid. The inner storage lid is pivotable between closed and open positions. The inner storage lid covers an opening of the storage compartment when the lid is in the closed position. The opening in the storage compartment is uncovered and accessible when the inner storage lid is pivoted to the open position.

In accordance with the preferred embodiment, the storage compartment has an interior space which is designed to receive a fish landing net having a frame in the shape of a tennis racquet. This enables a fisherman standing on the casting deck to store a fish landing net by simply lifting the inner storage lid, placing the fish landing net inside the storage compartment and then closing the lid.

In accordance with a further feature of the preferred embodiment, the storage compartment has a drainage feature whereby fluid dripping from the stored net flows through a drainage opening in the lowest point of the compartment bottom. The drained fluid exits the storage compartment at a location directly above an opening in the floor of the bilge compartment. This enables water from the stored fish landing net to be drained from the storage compartment into the bilge area.

Other features of the preferred embodiments will become apparent from a reading of the description of the preferred embodiments and the claims hereinafter.

DETAILED DESCRIPTION OF THE PREFERRED EMBODIMENTS

Figure 1:
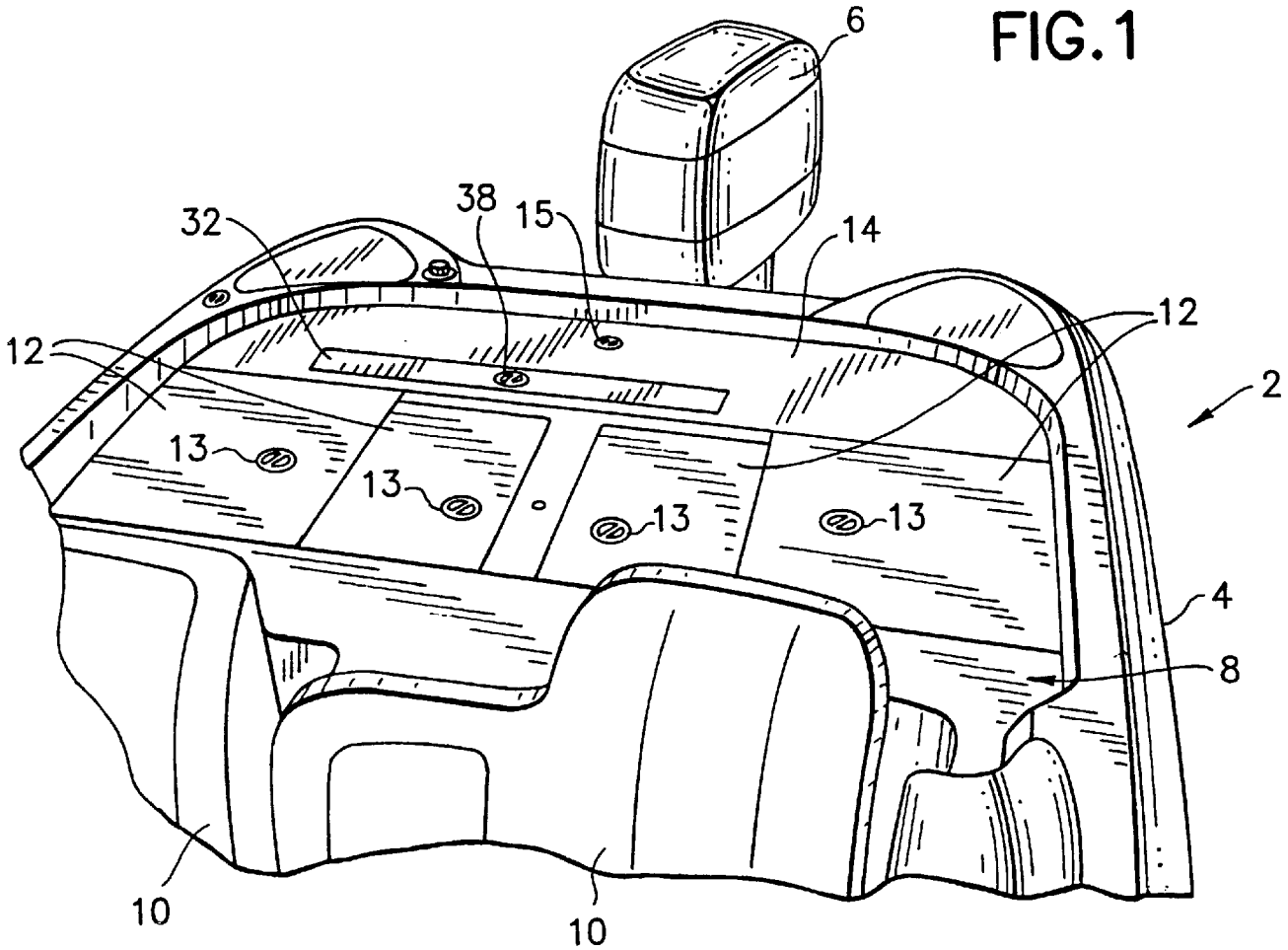
FIG. 1 schematic showing a perspective view of the stern of a fishing boat incorporating the present invention.

FIG. 1 shows the stern section of a fishing boat 2 in accordance with the preferred embodiment of the invention.

The fishing boat 2 comprises a hull 4 and an outboard engine 6. The reference numeral 8 generally designates an aft casting or fishing deck area located behind the cockpit. The only portion of the cockpit which is visible in FIG. 1 are the backs of seats 10. The boat may also have another casting deck area (not shown in FIG. 1) located in the bow section.

In conventional fashion, the aft casting deck area 8 is a generally flat structure which a fisherman can stand on. The aft casting deck area 8 is formed by a multiplicity of adjacent surfaces which abut at their respective edges to form a continuous level surface which is free of any upward projections on which a person might trip while traversing the casting deck. Also in conventional fashion, a multiplicity of storage compartments are arranged beneath the aft casting deck area 8. FIG. 1 shows a row of four lids 12, each lid 12 serving as an access hatch for a respective storage compartment. Each lid 12 is pivotably mounted via a respective hinge (not shown). A person on the boat may access any storage compartment by lifting the lid 12 covering the compartment. Each lid has a conventional latching mechanism which can be operated by rotating a respective handle 13. Each handle 13 is embedded in its corresponding lid so that a person standing on the casting deck cannot be tripped by the handle.

Figure 3:
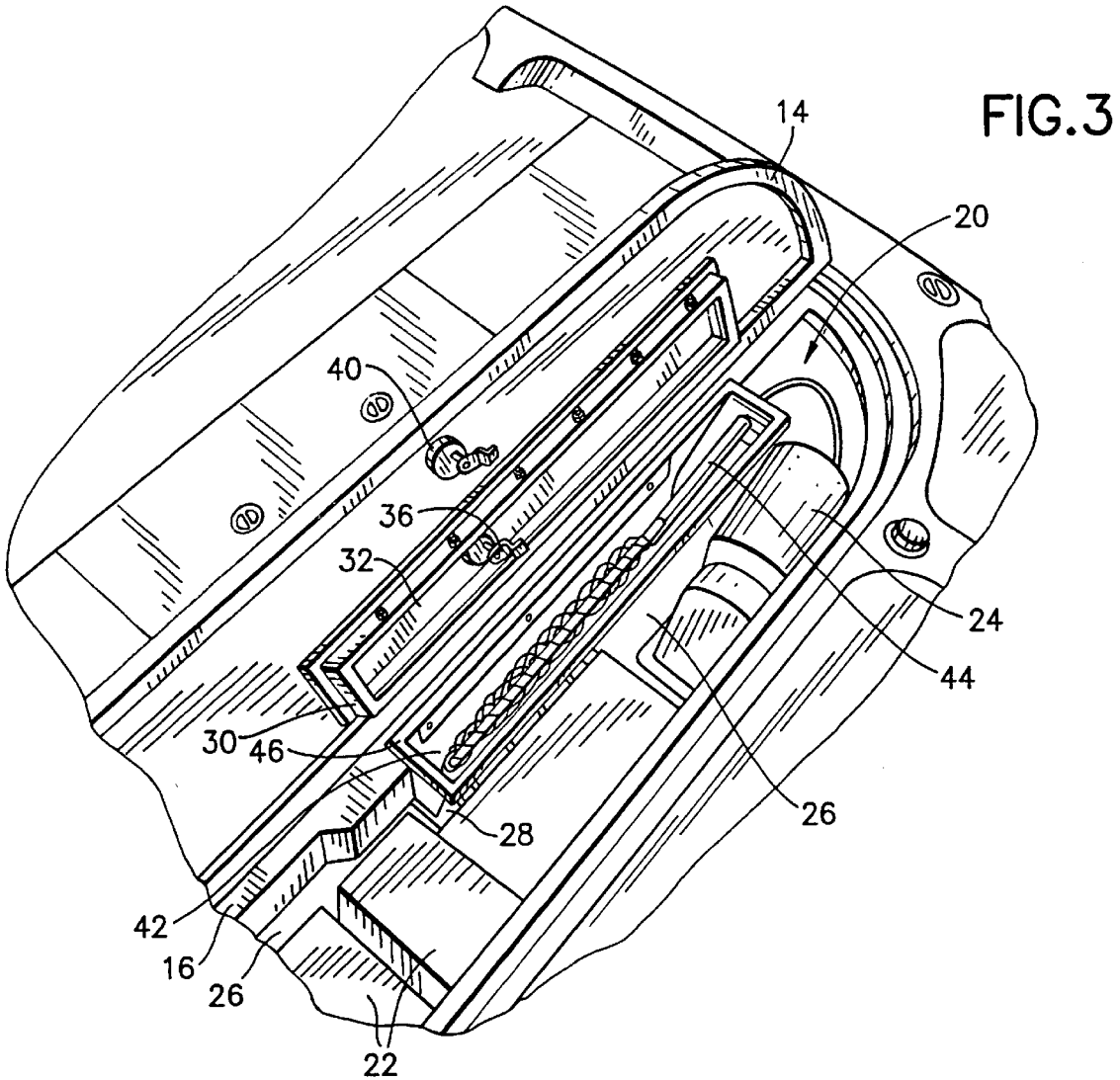
FIG. 3 is a schematic showing a perspective view of an open bilge compartment of a boat having a fish landing net storage compartment therein in accordance with the preferred embodiment of the invention.
Figure 4:
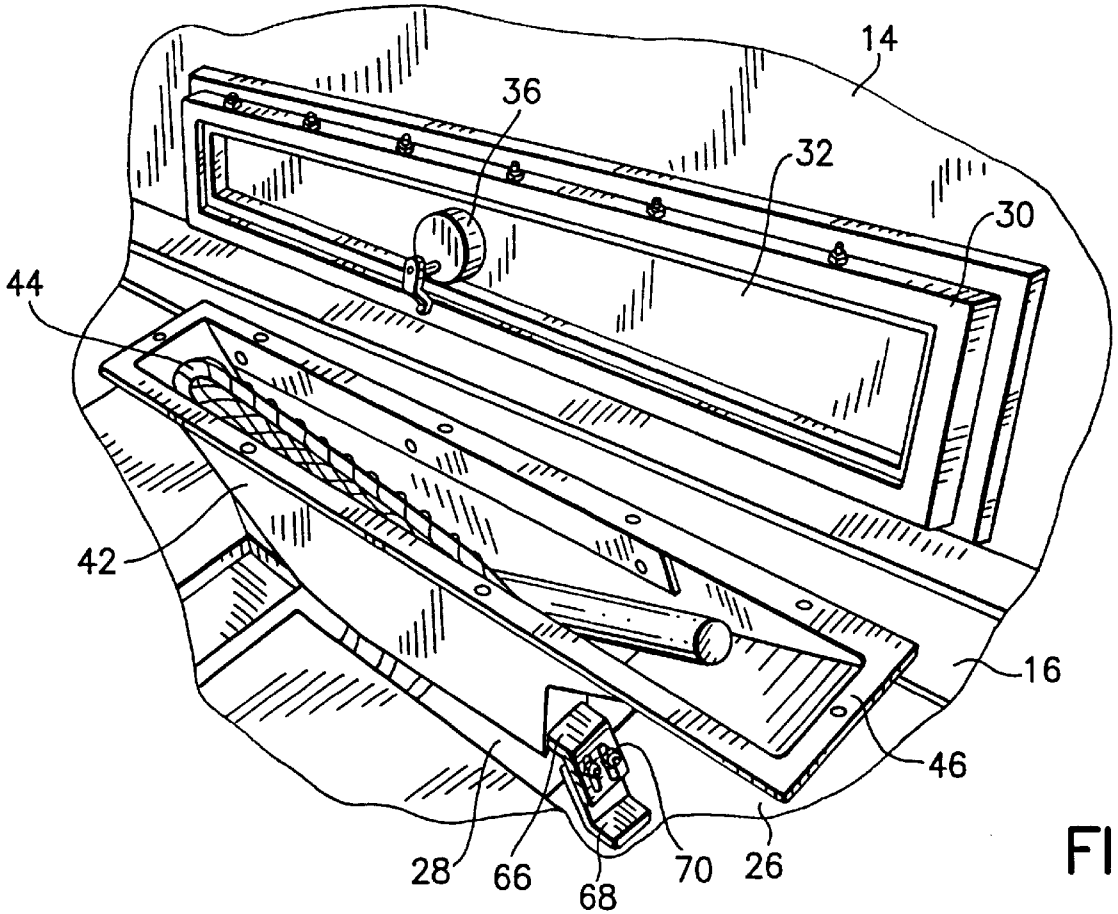
FIG. 4 is a schematic showing details of the way in which the fish landing net storage compartment is mounted within the bilge compartment in accordance with the preferred embodiment.

The boat depicted in FIG. 1 also has a bilge compartment located aft of the row of storage compartments. In accordance with the preferred embodiment of the present invention, the bilge compartment is covered by an outer bilge access lid 14, which has an embedded handle 15 similar to the handles previously described. As best seen in FIG. 4, the outer bilge access lid 14 is pivotably mounted to a top surface of a bulkhead 16 by means of a hinge (not visible). The bulkhead 16 is part of the deck. The outer bilge access lid 14 can be pivoted to open and close the bilge compartment, generally designated by reference numeral 20 in FIG. 3. FIG. 1 shows the outer bilge access lid 14 in its closed position; FIGS. 3 and 4 show the outer bilge access lid 14 in its open position. The bilge compartment 20 houses various equipment, such as batteries 22 and oil injection tank 24, which are mounted on opposite lateral portions of a floor 26. An opening 28 in the floor 26 communicates with the bilge area extending under the floor along the keel of the boat.

Figure 2:
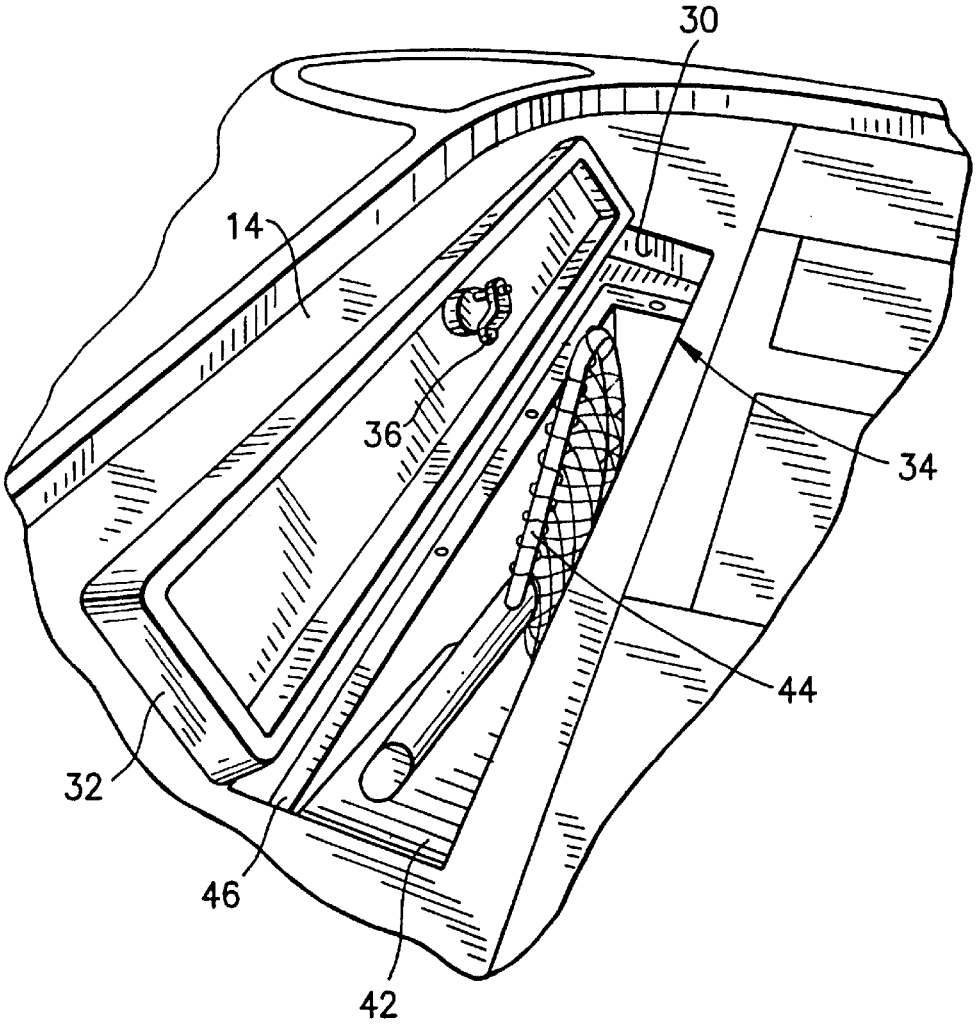
FIG. 2 is a schematic showing a perspective view of an open storage compartment in accordance with the preferred embodiment of the on, with a fish landing net inside the compartment.

As best seen in FIG. 4, the outer bilge access lid 14 in accordance with the preferred embodiment comprises a generally rectangular frame 30 attached (e.g., by welding) along the periphery of a generally rectangular opening (item 34 in FIG. 2) formed in the outer bilge access lid 14. A generally rectangular inner net storage lid 32 is seated in the generally rectangular opening 34 and is pivotably mounted to the frame 30 by means of a hinge (not visible in the drawings). The inner net storage lid 32 is pivotable between closed and open positions. The closed position, with the inner net storage lid 32 seated in the opening and flush with the outer bilge access lid 14, is shown in FIG. 1. The open position of the inner net storage lid 32 is shown in FIG. 2.

The inner net storage lid 32 in accordance with the preferred embodiment comprises a deck plate having a generally rectangular periphery with rounded corners and a peripheral wall extending generally orthogonally from that periphery on one side of the deck plate. The peripheral wall extends downward into the opening 34 when the inner net storage lid 32 is in its closed position. A conventional latching mechanism 36 is seated in a circular hole formed in the deck plate of the inner net storage lid 32. The latching mechanism 36 is coupled to an embedded handle 38, which is seen in FIG. 1. The latching mechanism and handle are commercially available as an integrated unit. A similar latching mechanism 40 (see FIG. 3) is installed in an opening in the outer bilge access lid 14.

Referring to FIG. 4, in accordance with the preferred embodiment of the invention, a storage compartment 42, designed to receive a racquet-shaped fish landing net 44, is installed within the bilge compartment. In particular, the storage compartment 42 is preferably mounted to the bulkhead 16 by means of a mounting plate 46, which contacts the bulkhead 16 along a top edge and an aft face. The storage compartment 42 extends downward along the aft face of the bulkhead 16. There is a wide gap between the storage compartment 42 and the aft edge of the bilge compartment 20, allowing easy access to the latter.

Figure 5:
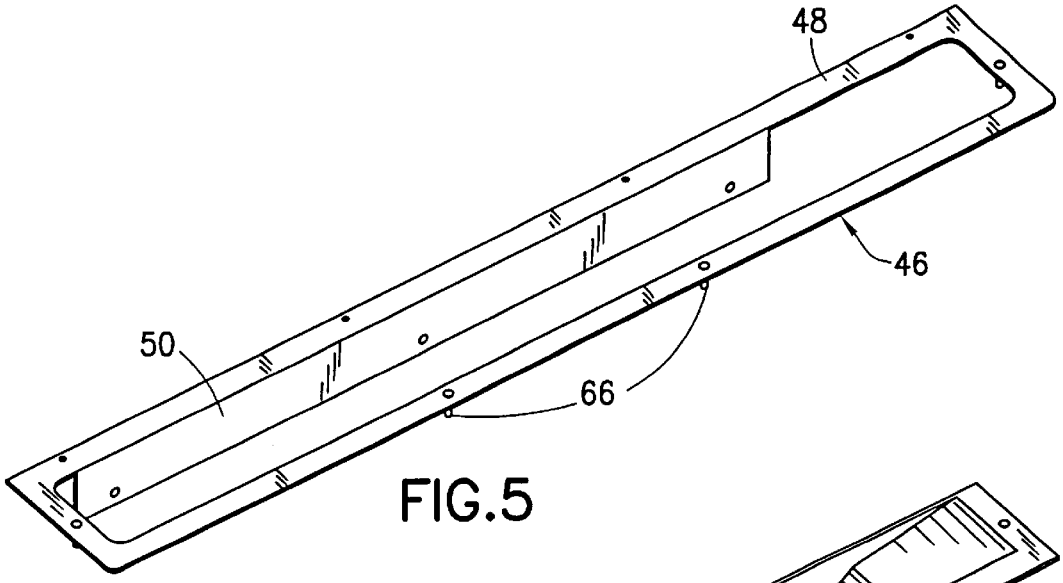
FIG. 5 is an isometric view of a mounting plate used to mount the storage compartment in the bilge compartment in accordance the preferred embodiment.

As shown in FIG. 5, the mounting plate 46, which is preferably made of aluminum, comprises a generally rectangular ring 48 and a side plate 50. The side plate 50 is a generally planar structure having a plurality of holes for fastening the storage compartment to the aft face of the bulkhead 16. The ring 48 is also generally planar, with the side plate 50 extending downward and generally perpendicular to the ring 48. The side plate 50 is preferably connected to a portion of an inner edge of one of the long sides of the ring 48, which side also has a plurality of holes for fastening that side of ring 48 to the top surface of the bulkhead 16.

Figure 6:
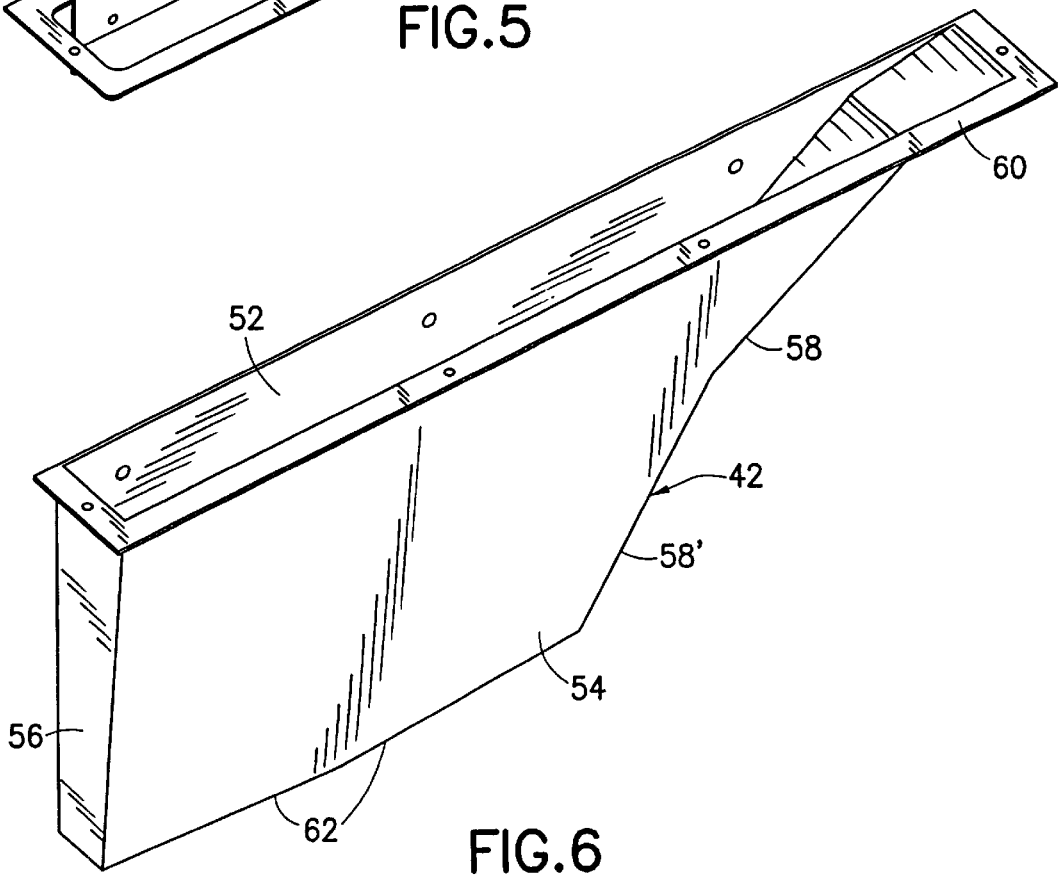
FIG. 6 is an isometric view of a fish landing net storage compartment in accordance with the preferred embodiment of the invention.

The mounting plate 46 is designed to be fastened to the storage compartment 42, allowing the latter to be mounted to the bulkhead via the mounting plate. The ring 48 is designed to fit on top of and be fastened to a three-sided top flange 60 on the storage compartment 42, shown in FIG. 6. The three sides of flange 60 are generally coplanar. Preferably, three sides of ring 48 (excluding the side connected to the side plate 50) overlap and are fastened to the three sides of top flange 60 by means of studs 66. The studs 66 are pressed into the mounting plate, pass through holes in the box and are secured with washers and nuts (not shown), thereby attaching the top flange 60 of the storage compartment 42 to the mounting plate 46. The flush mounted design of the pressed-in studs contributes to the "no snag" feature of this system. Preferably the mounting plate 46 is made of aluminum and the storage compartment 42 is made of polyethylene.

Figure 7:
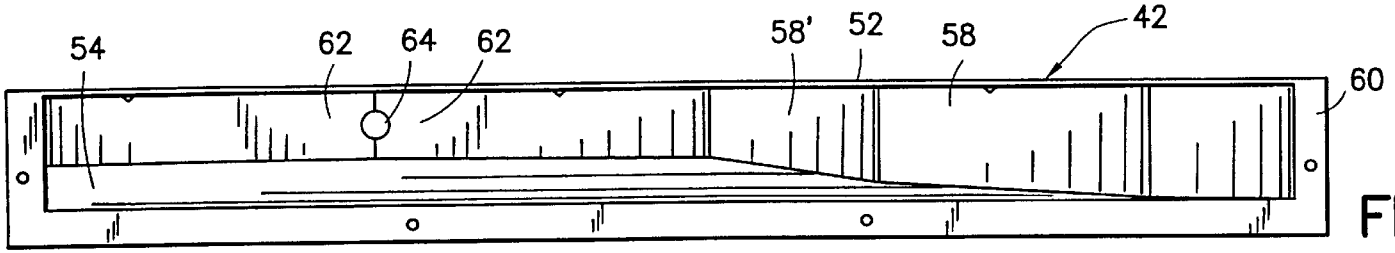
FIGS. 7–9 are top, side and end views, respectively, of the storage compartment depicted in FIG. 6.
Figure 9:
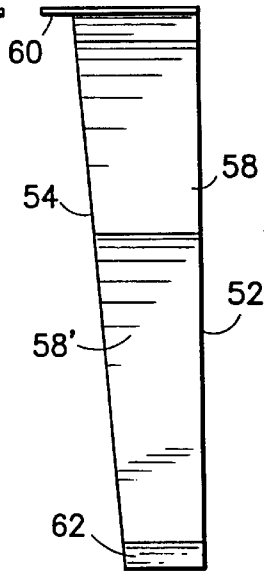
Figure 8:
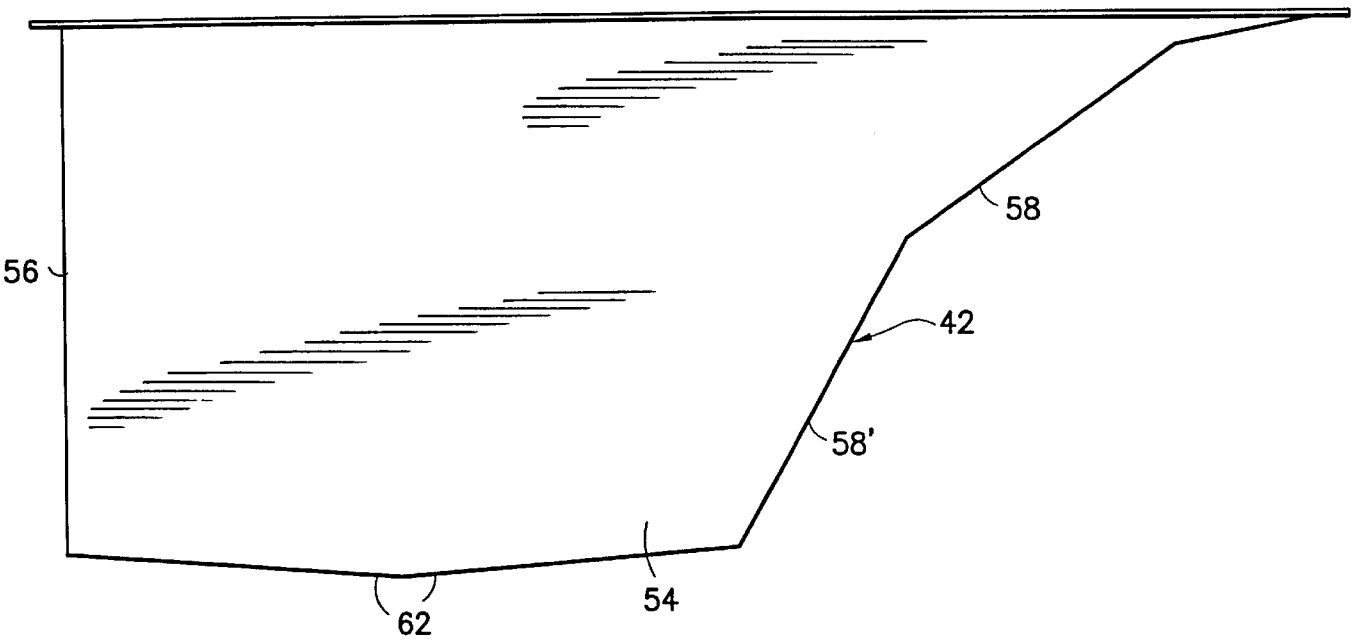

The storage compartment 42 is designed to lie against the vertical aft face of the bulkhead 26 and to receive a fish landing net comprising a relatively thin frame and a relatively thick handle. Preferably the storage compartment 42 is a molded plastic box having the shape shown in FIGS. 7–9. As best seen in FIG. 9, the storage box comprises a vertical planar side wall 52, which is generally perpendicular to the top flange 60, and an opposing inclined planar side wall 54 , which is separated from side wall 52 by a distance which decreases linearly with increasing depth. As best seen in FIG. 7, the three-sided flange extends outward the three edges of the opening at the top of the storage compartment, leaving the top opening clear of any obstruction on which the received fish landing net might become snagged. The interior volume of the storage compartment has the shape of an eight-sided geometric figure, with the length of the top of the compartment being greater than the length of the bottom of the compartment, as seen in FIG. 8. Six of those eight sides are transverse or lateral walls connecting the side walls 52 and 54. Referring to FIG. 8, end wall 56 is a generally vertical transverse wall, while the opposing end wall comprises first and second inclined walls 58 and 58'. The inclined wall 58' lies at a steeper angle than the inclined wall 58. In one exemplary embodiment, the inclined end wall 58 lies at an angle of 40–45 degrees relative to the plane of the flange 60. The storage compartment is designed so that the frame of the fish landing net lies on the bottom 62 of the compartment while the net handle leans against the inclined end wall 58 (as best seen in FIG. 4). In accordance with a further aspect of the preferred embodiment, the bottom 62 of the compartment comprises a pair of bottom walls arranged in a shallow V-shape with the vertex of the V at the lowest point of the wall. As seen in FIG. 8, the compartment 42 is provided with a drainage opening 64 at the vertex where bottom walls 62 are joined. The inclined inner surfaces of the bottom walls 62 funnel any fluid which drips off of the stored fish landing net toward the drainage opening 64. Any fluid passing through the drainage opening 64 will fall through the opening 28 in the bilge compartment floor to the bilge area, where excess fluid is accumulated.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A boat incorporating a storage system comprising:

a first compartment having a first opening and a first interior space communicating with said opening;

a first lid pivotably mounted relative to said first compartment and having a second opening, said first lid being pivotable between first and second positions, said first lid covering said first opening of said first compartment when said first lid is in said first position and said first opening in said first compartment being open when said first lid is in said second position;

a frame attached to a periphery of the second opening, said frame having a third opening aligned with said second opening;

a second compartment arranged in said first interior space of said first compartment, said second compartment having a fourth opening and a second interior space communicating with said fourth opening, said fourth opening being aligned with said third opening when said first lid is in said second position, wherein said second compartment comprises first and second mutually opposing and mutually non-parallel side walls, first and second planar bottom walls that meet at a junction at a lowest point of said second compartment, said first and second planar bottom walls forming an angle slightly less than 180 degrees, each of said first and second bottom walls being joined to said first and second side walls, a drainage opening at said lowest point, a substantially vertical first end wall joined to said first and second side walls and to said first bottom wall, a second end wall opposing said first end wall and joined to said first and second side walls and to said second bottom wall, said second end wall being inclined at a first angle relative to said first end wall, and a third end wall opposing said first end wall and joined to said first and second side walls and to said second end wall, said second end wall being inclined at a second angle relative to said first end wall, said second angle being greater than said first angle, wherein the width of said second compartment increases linearly from bottom to top, and the length of said second compartment increases linearly from the bottom of said second end wall to the top of said second end wall at a first rate and increases linearly from the bottom of said third end wall to the top of said third end wall at a second rate greater than said first rate; and a second lid pivotably mounted to said frame, said second lid being pivotable between third and fourth positions, said second lid covering said second opening of said first lid when said second lid is in said third position, said second opening in said first lid being open when said second lid is in said fourth position, whereby said fourth opening in said second compartment is open when said first lid is in said first position and said second lid is in said fourth position, and said fourth opening in said second compartment is closed by said second lid when said first lid is in said first position and said second lid is in said third position.

2. The boat as recited in claim 1, wherein said first compartment comprises a wall and said second compartment is mounted to said wall.

3. The boat as recited in claim 2, further comprising a mounting plate comprising first and second planar portions, said first planar portion being in the shape of a ring having an inner edge, and said second planar portion being connected to said inner edge of said first planar portion and extending generally perpendicular to said first planar portion.

4. The boat as recited in claim 3, wherein said first planar portion and one part of said second planar portion of said mounting plate are fastened to said wall.

5. The boat as recited in claim 4, wherein said second compartment comprises a flange which extends partially around a periphery of said fourth opening of said second compartment, said flange of said second compartment being fastened to another part of said second planar portion of said mounting plate.

6. The boat as recited in claim 3, wherein said mounting plate is made of metal and said second compartment is made of plastic material.

7. The boat as recited in claim 6, wherein said mounting plate is made of aluminum and said second compartment is made of polyethylene.

8. The boat as recited in claim 1, further comprising a floor which forms a part of said first compartment and an adjustable-length mounting bracket having an adjustable length, said adjustable-length mounting bracket having one end attached to said floor and another end attached to said second compartment.

9. A boat comprising a casting deck, a bilge compartment underneath said casting deck, and a storage compartment arranged within said bilge compartment, wherein said bilge compartment has a first opening and said storage compartment has a second opening and an interior space in communication with said second opening, and said casting deck comprises a first pivot able deck portion overlying said second opening and a second pivot able deck portion overlying said first opening and having a third opening, said first pivot able deck portion being seated in said third opening and pivot able relative to said second pivot able deck portion, said second opening of said storage compartment being closed when said first pivot able deck portion is in a first angular position flush with said second pivotable deck portion, and said interior space of said storage compartment being accessible via said second and third openings when said first pivot able deck portion is in a second angular position not flush with said second pivot able deck portion, wherein said interior space of said storage compartment is configured to hold a fish landing net with its frame generally vertical, said bilge compartment being covered by said second pivot able deck portion when said second pivot able deck portion is in a third angular position and accessible when said second pivot able deck portion is in a fourth angular position.

10. The boat as recited in claim 9, further comprising a bulkhead forming part of said bilge compartment, and means for mounting said storage compartment to said bulkhead.

11. The boat as recited in claim 9, further comprising a floor and an adjustable-length mounting bracket having an adjustable length, said adjustable-length mounting bracket having one end attached to said floor and another end attached to said storage compartment.

12. The boat as recited in claim 9, wherein said storage compartment comprises a drainage opening formed at a lowest point of a bottom portion.

13. The boat as recited in claim 9, wherein said storage compartment comprises first and second side walls which are not mutually parallel, and first and second end walls which are not mutually parallel.

14. The boat as recited in claim 9, further comprising a generally vertical wall, said storage compartment being mounted to said wall.

15. A boat comprising:

a hull and a bulkhead that form a bilge compartment having an opening that communicates with a bilge area extending along a keel of said hull;

a casting deck comprising a bilge access lid hinged to said bulkhead;

a storage compartment located inside said bilge compartment, wherein said storage compartment comprises a drainage opening formed at a lowest point of a bottom portion, said drainage opening being positioned so that fluid inside said storage compartment flows into said bilge compartment; and a mounting plate for mounting said storage compartment to said bulkhead, wherein said mounting plate comprises a generally planar and generally rectangular ring comprising first through fourth sides and a generally planar side plate joined to and extending generally perpendicular from said first side of said ring, said side plate and said first side of said ring contacting said bulkhead, wherein said storage compartment further comprises a generally planar top flange that attaches to said second side of said ring of said mounting plate.

16. The boat as recited in claim 15, wherein said second compartment comprises first and second mutually opposing and mutually non-parallel side walls, first and second planar bottom walls that meet at a junction at a lowest point of said second compartment, said first and second planar bottom walls forming an angle slightly less than 180 degrees, each of said first and second bottom walls being joined to said first and second side walls, said drainage opening being located at said lowest point, a substantially vertical first end wall joined to said first and second side walls and to said first bottom wall, a second end wall opposing said first end wall and joined to said first and second side walls and to said second bottom wall, said second end wall being inclined at a first angle relative to said first end wall, and a third end wall opposing said first end wall and joined to said first and second side walls and to said second end wall, said second end wall being inclined at a second angle relative to said first end wall, said second angle being greater than said first angle, wherein the width of said second compartment increases linearly from bottom to top, and the length of said second compartment increases linearly from the bottom of said second end wall to the top of said second end wall at a first rate and increases linearly from the bottom of said third end wall to the top of said third end wall at a second rate greater than said first rate.

* * * * *

UNITED STATES PATENT AND TRADEMARK OFFICE

CERTIFICATE OF CORRECTION

PATENT NO. : 6,415,733 B1
DATED : July 9, 2002
INVENTOR(S) : Hudson et al.

It is certified that error appears in the above-identified patent and that said Letters Patent is hereby corrected as shown below:

Column 6,
Lines 58, 59, 61 and 64, "pivot able" should read -- pivotable --
Line 62, "and pivot able relative to said second pivot able" should read
-- and pivotable relative to said second pivotable --

Column 7,
Lines 1, 2 and 8, "pivot able" should read -- pivotable --
Line 6, "second pivot able deck portion when said second pivot able" should read
-- second pivotable deck portion when said second pivotable --

Signed and Sealed this

Fifth Day of August, 2003

JAMES E. ROGAN
*Director of the United States Patent and Trademark Office*